US005153390A

United States Patent [19]

Barkman et al.

[11] Patent Number: 5,153,390

[45] Date of Patent: Oct. 6, 1992

[54] METHOD FOR AVOIDING TERMINAL LANDING POSITION INITIALIZATION AFTER POWER LOSS

[75] Inventors: William F. Barkman, Canton; Jeremy B. Kezer, New Britain; Julian H. Shull, Southington, all of Conn.

[73] Assignee: Otis Elevator Company, Farmington, Conn.

[21] Appl. No.: 670,110

[22] Filed: Mar. 15, 1991

[51] Int. Cl.[5] ..... B66B 3/02

[52] U.S. Cl. ..... 187/134

[58] Field of Search ..... 187/122, 134, 101, 136

[56] References Cited

U.S. PATENT DOCUMENTS

| | | | |
|---|---|---|---|
| 3,898,611 | 8/1975 | Mandel | 187/136 |
| 4,096,925 | 6/1978 | Koob et al. | 187/134 |
| 4,433,756 | 2/1984 | Caputo et al. | 187/134 |
| 4,436,185 | 3/1984 | Ludwig et al. | 187/101 |
| 4,658,935 | 4/1987 | Holland | 187/122 |
| 4,750,592 | 6/1988 | Watt | 187/134 |

*Primary Examiner*—A. D. Pellinen

*Assistant Examiner*—Lawrence E. Colbert

*Attorney, Agent, or Firm*—Breffni X. Baggot

[57] ABSTRACT

In an elevator system, primary marking means, placed near every floors and secondary marking means placed near alternate floors are read by a scanner. Upon scanning, a marking number signal is provided indicating whether a primary marking means and secondary marking means, or only a primary marking means, is read at a floor level. As the car moves in the hoistway, current position, direction of the elevator car, and the marking number signal is continuously updated and stored in non-volatile memory. Upon recovery from a loss of power, the car is moved to the next floor in the direction it was moving prior to loss of power. By comparing the marking number signal stored in non-volatile memory before power was lost with the marking number signal generated after regaining power, the stored position can be confirmed to be correct or, if incorrect, incremented or decremented by one floor, depending upon whether the car was moving up or down respectively, to identify the actual car position.

11 Claims, 1 Drawing Sheet

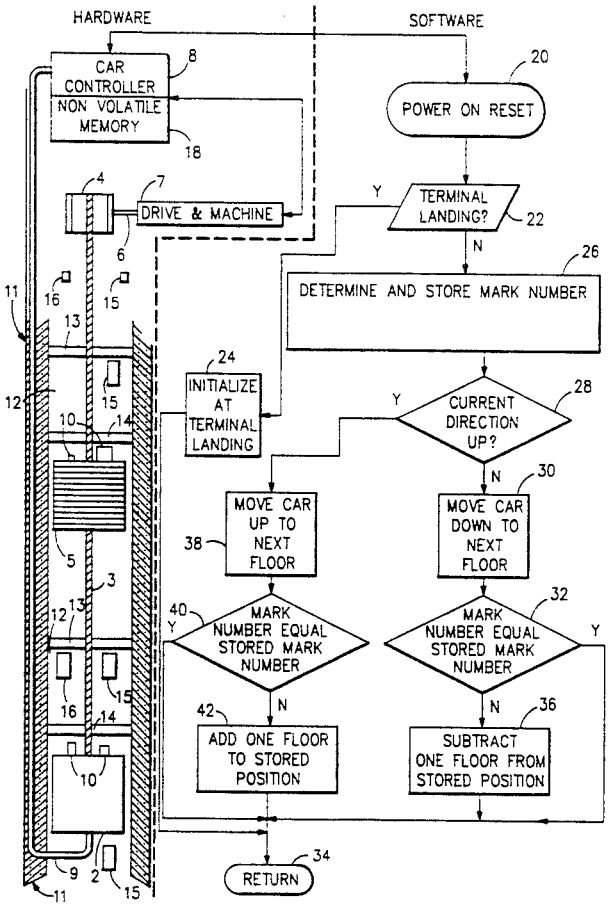

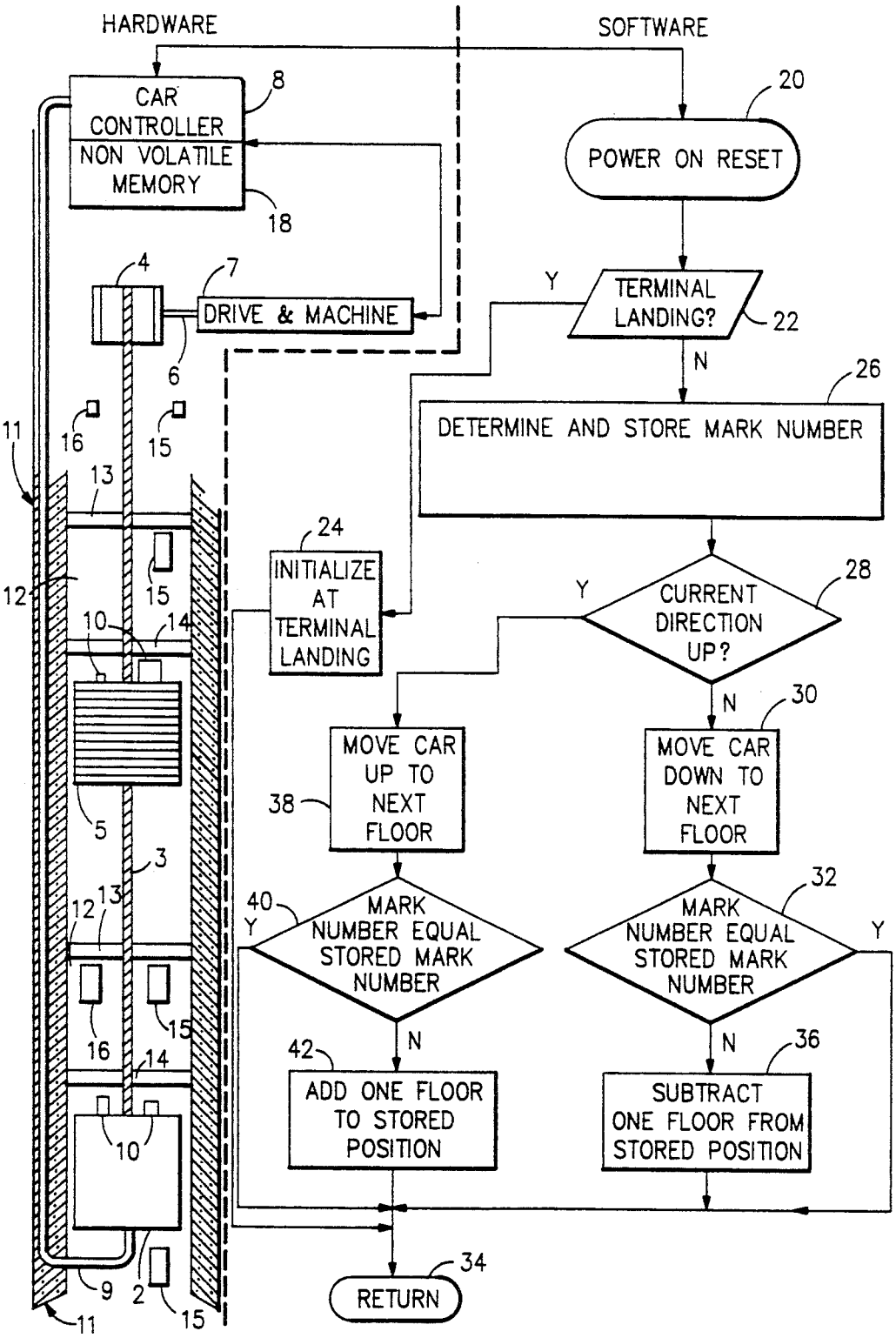
HARDWARE
SOFTWARE
CAR CONTROLLER
NON VOLATILE MEMORY
8
18
POWER ON RESET
20
DRIVE & MACHINE
4
7
6
TERMINAL LANDING?
22
Y
N
DETERMINE AND STORE MARK NUMBER
26
INITIALIZE AT TERMINAL LANDING
24
CURRENT DIRECTION UP?
28
MOVE CAR UP TO NEXT FLOOR
38
MOVE CAR DOWN TO NEXT FLOOR
30
MARK NUMBER EQUAL STORED MARK NUMBER
40
32
ADD ONE FLOOR TO STORED POSITION
42
SUBTRACT ONE FLOOR FROM STORED POSITION
36
RETURN
34
11
12
13
14
15
16
10
5
3
2
9

METHOD FOR AVOIDING TERMINAL LANDING POSITION INITIALIZATION AFTER POWER LOSS

TECHNICAL FIELD

This invention relates to detecting the position of an elevator car.

BACKGROUND OF THE INVENTION

In an elevator control system, it is essential to detect the position of the elevator car. There are several methods for doing this.

Simple elevators use hoistway vanes or cams to indicate floor location and count these as the car moves up and down the hoistway to determine position. These schemes require an initialization at an absolute position, usually by sensing a contact at a terminal landing, when the system is powered up. The motion control system then requires the car to be initialized every time the power is removed, then reapplied to the car controller. One way in which this is presently done is by moving the car to a terminal landing and sensing a limit switch. The position information may be stored in non-volatile memory so that it is not lost when power is removed. A problem exists, however, such that if the car is in motion and approaching a vane or cam when power is lost, a position error of one floor may exist when power is reapplied. This is due to the car passing over the vane after power is removed before coming to rest. Because of recent changes to the B44, Canadian Elevator Code, a correction to a terminal landing is not allowed when power is lost and reapplied.

SUMMARY OF THE INVENTION

According to the present invention, in an elevator system, primary marking means, placed near every floor and secondary marking means placed near alternate floors are read by a scanner. Upon scanning, a number signal is provided indicating whether a primary marking means and secondary marking means, or only a primary marking means, is read. As the car moves in the hoistway, current position, direction of the elevator car, and the marking number signal is continuously updated and stored in non-volatile memory. Upon recovery from a loss of power, the car is moved to the next floor in the direction it was moving prior to loss of power. By comparing the marking number signal stored in non-volatile memory before power was lost with the marking number signal generated after regaining power, the stored position can be confirmed to be correct or, if incorrect, incremented or decremented by one floor, depending upon whether the car was moving up or down respectively, to identify the actual car position.

It is an object of the present invention to determine the position of an elevator car.

It is an object of the present invention to avoid a terminal landing position initialization after a power loss.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 1 is a flow chart of the software used by the present invention and a somewhat schematic fragmented sectional view of the hardware in an elevator system using the present invention.

DESCRIPTION OF THE PREFERRED EMBODIMENT(S)

FIG. 1 shows an elevator car 2 suspended by a cable 3 looped around a sheave 4 and balanced by a counterweight 5. Rotation of the sheave 4 is controlled by means of the shaft 6 and drive and machine 7. The drive and machine 7, in turn, is controlled by the car controller 8. Power to the car 2, and communication between the car 2 and car controller 8, is conducted on the traveling cable 9.

On top of the car 2 are scanners 10. A single scanner may also be used. These scanners may be, for example, optical readers. At each floor level 11, the doors 12 are bounded by top and bottom door sills 13, 14. At each floor level in the building, a primary mark 15 is positioned. These marks have a number of indicia and a type of indicia. A secondary mark 16 is positioned at alternate floors. Further, in the preferred embodiment, these marks 15 are all of the same nature; they are vanes. They are mounted on the hoistway doors 12.

In still another embodiment, the number of marks, rather than increasing by one mark from one to two increases in sequence increases from one to three by one mark in sequence. For example, one vane at the first floor, two at the second, and three at the third, with the numbering sequence beginning again at the fourth floor. The numbering is not limited to three.

The car controller 8 contains a control processor (not shown) including a central processing unit (CPU) (not shown), and non-volatile memory 17. Data acquisition results, including car position and direction are gathered and stored in the non-volatile memory 17. The car 2 does not slide more than one floor after brakes have been applied in response to a power loss.

Following a loss of power, the method of FIG. 1 is executed at step 20, power on reset. One of the major objects of the present invention is to avoid the need for a terminal landing initialization after power loss. Accordingly, if the car 2 is at a terminal landing, step 22 affirmative, whether the top terminal landing or bottom terminal landing, absolute position is established by the top or bottom terminal landing switches (not shown), step 24. If, however, the car 2 is not at a terminal landing, step 22 negative, then in step 26, using the stored position it is determined whether the last door the car passed before power went off was at a floor with two vanes or only one. This determines the number of the mark at the floor. Because in the preferred embodiment two vanes are placed at odd floors and one at successive floors, the determination is accomplished by means of a mathematical function: modulo (stored position, 2). For example, if the stored position is an even number, the modulo (stored position, 2) yields zero. If the car 2 is at an odd floor, the modulo (stored position, 2) yields a one. In step 26, the mark number is 0 or 1, depending upon whether the car is positioned at a floor with two vanes or one. This value, a variable "MARK NUMBER", is recorded in a non-volatile memory location "STORED-MARK NUMBER". Then, in step 28, it is determined in what direction the car was going when power was lost.

If, when power was lost, the car was traveling in the down direction, test 28 negative, the car is moved, by means of the drive 7, down to the next floor, step 30.

Here, the car may re-initialize its position. The motion control system moves the car in the same direction of travel as when power was lost, as long as a terminal landing has not been detected. Once the car 2 has arrived at the next floor, the mark number is checked by the car controller, step 32. Thus, in step 32, the scanners 10 read the vane(s). If the value of "STORED-MARK NUMBER" is not equal to "MARK NUMBER", the stored position is correct and the routine ended, step 34. If, however, "STORED-MARK NUMBER" equals "MARK NUMBER", the stored position is off by one floor and is corrected in step 36 where a value equal to one floor is subtracted from the stored position. The methodology for a car traveling in the up direction, step 28 affirmative, is similar, except that if the stored position is off by one floor, then one floor is added to the stored position in the non-volatile memory 18.

The number of marks is not limited to one at successive floors and two at alternate successive floors. For example, there could be positioned one vane at a first floor, two at a second, and three at a third floor with the cycle repeating. In this embodiment, the car would be moved to the next floor in the direction it was moving when power was lost. Using a look-up table, the car controller compares the stored position with the expected number of indicia at the next floor. If the number of indicia at the next floor is not equal to the number of marks according to the look-up table, the stored position is corrected by adding, if the car was moving up, or subtracting, if the car was moving down, a number corresponding to the difference between the look-up table and the number of marks read.

While the present invention has been illustrated and described in conjunction with a single preferred embodiment thereof, it is to be understood that numerous changes and modifications may be resorted to without departing from the spirit and scope of the present invention. In particular, the nature of mark at or near the floor levels need not be vanes; any marking means, for example vanes, will perform a similar function. The relationship between mark and scanner need not be optical, such as an optical reader and a vane. An equivalent relationship would be mechanical, such as a cam and a cam scanner, or acoustical, magnetic, or pressure-based. If bar codes are used as the marks 16 and bar code readers as the scanners 10, only one of each is needed, per floor, and steps 26, 32, 36, 40 and 42 may be omitted without departing from the invention. Further, the mark need not be placed upon the hoistway doors 13, but rather anywhere near a floor level. Still further, the scanners 10 need not be placed on top of the car 2; their positioning on the sides, front and rear, or bottom would also fall within the embodiment. Still further, the scanners 10 may be placed upon the counterweight 5, whether on the top, the bottom, the front, the back, or the sides. In FIG. 1, scanners are mounted upon the counterweight. If counterweight scanners are used, cab-mounted scanners need not be.

We claim:

1. In an elevator system, a method for determining the floor position of an elevator car after it has lost power, comprising the steps:

providing primary marking means in a region near every floor;

providing secondary marking means near alternate floors;

storing the position and direction of the car in non-volatile memory;

scanning said region for providing a marking number signal in response to said primary and secondary marking means, indicating whether only a primary marking means exists in said scanned region or both a primary marking means and a secondary marking means;

storing said marking number signal in non-volatile memory;

upon recovery from a loss of power, moving said car to the next floor in the direction it was moving prior to said loss of power;

comparing the marking number signal at said next floor with the number signal in said non-volatile memory and providing a difference signal;

correcting said position, if said difference signal is nonzero, including incrementing said position when said direction is up;

decrementing said position when said direction is down.

2. A method for determining the floor position of an elevator car upon regaining power after a loss of power to said car, said method comprising the steps:

providing a first type of marking means near alternate elevator floor landings and a second type of different marking means near the intervening elevator floor landings;

sensing the type of marking means and landing floor number of the most recent landing passed by the elevator car during normal operation of the elevator and storing said sensed type information in a non-volatile elevator controller memory before said power loss;

sensing the direction of movement of the elevator car during normal operation thereof and storing the most recent direction in non-volatile memory before power loss;

immediately after regaining power, moving said car in the stored direction of movement to the next floor, sensing the type of marking means at said next floor;

comparing the type of sensed marking means at said next floor with the type of marking means sensed before to shutdown; and correcting the floor number when the type of said compared marking means is the same.

3. An elevator car position measurement method, comprising:

providing one or more marks in a region at each floor level, arranging said marks in a sequence such that the number of marks at adjacent floors in the sequence differs by one;

scanning said regions;

storing the sequence as said car moves in the hoistway in non-volatile memory;

storing the position and direction of said car in non-volatile memory;

upon recovery from a loss of power, moving said car to the next floor in the direction it was moving prior to said loss of power;

comparing the number of marks read at said next floor after regaining power with the number of marks stored in non-volatile memory before loss of power and providing a difference signal;

correcting said position, if said difference signal is nonzero, including incrementing said stored position by said difference if the stored direction is up; and decrementing said stored position by said difference when said stored direction is down.

4. An elevator car position measurement apparatus, comprising:

marking means positioned in a region, said marking means including primary marking means, placed near every floor and secondary marking means near alternate floors;

scanning means for providing a marking number signal, indicating whether only a primary marking means or both a primary marking means and a secondary marking means exists in said, region;

means for upon recovery from a loss of power to said door, moving said car to the next floor in the direction it was moving prior to said loss of power;

non-volatile memory means for storing the position and direction of said car and said marking number signal, thereby providing a stored position signal, a stored direction signal, and a stored marking number signal;

correction means, operable after said lost power has been recovered and car has been braked and moved to the nearest floor in the direction stored immediately before it lost power, for comparing said marking number signal stored in non-volatile memory before said power loss to said marking number signal, provided immediately after power is recovered, and incrementing said stored position when said signals are equal and said stored direction is up and decrementing said stored position when said signals are equal and said stored direction is down.

5. The apparatus of claim 4, wherein said scanning means is positioned upon a counterweight to an elevator car.

6. The apparatus of claim 4, wherein said scanning means is positioned upon said elevator car.

7. The apparatus of claim 4, wherein said scanning means is positioned upon the roof of said elevator car.

8. The method of claim 1 wherein the car slides no more than one floor, in the direction it was moving in when it lost power, between the time when said power loss occurs and the time when power is recovered.

9. The method of claim 2 wherein the car slides no more than one floor, in the direction it was moving in when it lost power, between the time when said power loss occurs and the time when power is recovered.

10. The apparatus of claim 4, wherein the car slides no more than one floor, in the direction it was moving in when it lost power, between the time when said power loss occurs and the time when power is recovered.

11. The method of claim 3 wherein upon recovery from loss of power, the car is no farther than the maximum number of floors in said sequence from its position when power was lost.

* * * * *